US007709068B2

(12) United States Patent
Kaimoto

(10) Patent No.: US 7,709,068 B2
(45) Date of Patent: May 4, 2010

(54) INKJET RECORDING MEDIUM

(75) Inventor: Hideki Kaimoto, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 12/203,747

(22) Filed: Sep. 3, 2008

(65) Prior Publication Data

US 2009/0087595 A1 Apr. 2, 2009

(30) Foreign Application Priority Data

Sep. 28, 2007 (JP) ..... 2007-255365

(51) Int. Cl.
*B41B 5/00* (2006.01)

(52) U.S. Cl. ..... 428/32.21; 428/32.18; 428/32.2; 428/32.28; 428/32.34

(58) Field of Classification Search ..... 428/32.18, 428/32.2, 32.21, 32.28, 32.34
See application file for complete search history.

(56) References Cited

U.S. PATENT DOCUMENTS

| | | | | |
|---|---|---|---|---|
| 6,436,515 | B1 * | 8/2002 | Ohbayashi et al. | 428/32.33 |
| 2002/0008752 | A1 * | 1/2002 | Tokunaga et al. | 347/106 |
| 2007/0148375 | A1 * | 6/2007 | Suzuki et al. | 428/32.1 |

FOREIGN PATENT DOCUMENTS

| | | | |
|---|---|---|---|
| JP | 2001-98492 | A | 4/2001 |
| JP | 2001-260529 | A | 9/2001 |

* cited by examiner

*Primary Examiner*—Betelhem Shewareged
(74) *Attorney, Agent, or Firm*—Sughrue Mion, PLLC

(57) ABSTRACT

An inkjet recording medium including a resin-coated paper including a base paper and at least one resin layer on each of both faces of the base paper, and an ink-receiving layer on one face of the resin-coated paper, wherein the inkjet recording medium includes linear concavities and convexities that are formed in parallel or approximately parallel to any one side of the resin-coated paper on at least a part of the face of the resin-coated paper on which the ink-receiving layer is not formed.

10 Claims, 4 Drawing Sheets

INKJET RECORDING MEDIUM

CROSS-REFERENCE TO RELATED APPLICATION

This application claims priority under 35 USC 119 from Japanese Patent Application No. 2007-255365, the disclosure of which is incorporated by reference herein.

BACKGROUND OF THE INVENTION

1. Field of the Invention

The present invention relates to an inkjet recording medium, which is a medium to be recorded by ink ejected in an inkjet recording method.

2. Description of the Related Art

Recently, an inkjet recording method is widely used in offices as well as in home use, etc.

In an inkjet recording method, an inkjet recording medium in which a recording layer having a porous structure for receiving ink is formed has been developed for the purpose of improving various characteristics, and been practically used. For example, there is an inkjet recording medium including a support and provided thereon a recording layer having high porosity that includes inorganic pigment particles and a water-soluble binder. Such an inkjet recording medium is excellent in an ink receiving property (quick-drying property) due to the porous structure, also has high glossiness, and is widely used as a material that enables recording of photograph-like images.

On the other hand, there is a demand for transport pathways such as front paper feeding and front paper ejection for downsizing of inkjet printers or easiness of handling of inkjet printers.

However, conventional inkjet recording materials that have been used until now, for example, inkjet recording materials including a support having a base paper and resin layers formed on both faces of the base paper and a porous-type ink-receiving layer formed on the support, are brittle upon bending. Specifically, they have problems of breaking and cracking when they are passed through a transport pathway having small curvature under environments with low temperature and low humidity.

Meanwhile, a support for imaging materials, which is covered with a roughened resin layer (e.g., see Japanese Patent Application Laid-Open (JP-A) No. 2001-98492), and an inkjet recording medium including a support having an ink absorbing layer on one face thereof and an embossed surface on the other face thereof (e.g., see JP-A No. 2001-260529) have been disclosed. It has been reported that the former is excellent in pencil-writing property and the latter allows easy distinction of the recording surface from the other surface.

As mentioned above, materials in which a back face opposite to the recording surface is roughened and materials in which a back face is embossed have conventionally existed. However, materials merely having such structures have poor effects to improve brittleness of recording materials having porous layers, for example, cracking of porous layers. Furthermore, the latter has low rigidness in both length and width directions when it is held by hand, and the product quality is also deteriorated.

SUMMARY OF THE INVENTION

According to an aspect of the invention, there is provided an inkjet recording medium comprising a resin-coated paper comprising a base paper and at least one resin layer on each of both faces of the base paper, and an ink-receiving layer on one face of the resin-coated paper, wherein the inkjet recording medium comprises linear concavities and convexities that are formed in parallel or approximately parallel to any one side of the resin-coated paper on at least a part of the face of the resin-coated paper on which the ink-receiving layer is not formed.

BRIEF DESCRIPTION OF THE DRAWINGS

FIG. 3A is a cross-sectional drawing showing concavities and convexities in which the cross-section shows wave shape, FIG. 3B is a cross-sectional drawing showing concavities and convexities in which the cross-section shows rectangular shape, FIG. 3C is a cross-sectional drawing showing concavities and convexities in which the cross-section has triangular shape, and FIG. 3D is a cross-sectional drawing showing concavities and convexities in which the cross-section has rectangular shape having different widths of concavities and convexities.

DETAILED DESCRIPTION OF THE INVENTION

Hereinafter the inkjet recording medium of the present invention is explained in detail.

The inkjet recording medium of the invention is an inkjet recording medium including a resin-coated paper (e.g., one having a rectangular form) including a base paper and at least one resin layer on each of both faces of the base paper, and an ink-receiving layer on one face of the resin-coated paper, wherein the inkjet recording medium includes linear concavities and convexities that are formed in parallel or approximately parallel to any one side (e.g., of four sides of the rectangle) of the resin-coated paper on at least a part of the face (back face) of the resin-coated paper on which the ink-receiving layer is not formed.

In the invention, by forming linear concavities and convexities in parallel or approximately parallel to any one side of the resin-coated paper (support) on a part or a whole of the back face of the resin-coated paper on which the ink-receiving layer is not formed, brittleness (specifically under an environment of low temperature and low humidity) of the ink-receiving layer against bending in the direction that crosses the linear direction (preferably in the direction orthogonal to the linear direction) can be alleviated, whereby occurrence of breaking or cracking of the ink-receiving layer due to bending provided by the transport pathway or handling during printing in an inkjet printer can be prevented.

Furthermore, since concavities and convexities are provided by setting the linear direction so as to be orthogonal or approximately orthogonal to the transport direction during transport, specifically side direction that does not cross the transport direction of the recording medium to be transported (e.g., a longer side of the rectangle), rigidness and elasticity as paper are not deteriorated, and the recording medium is excellent in quality when held by hand.

Figure 1:
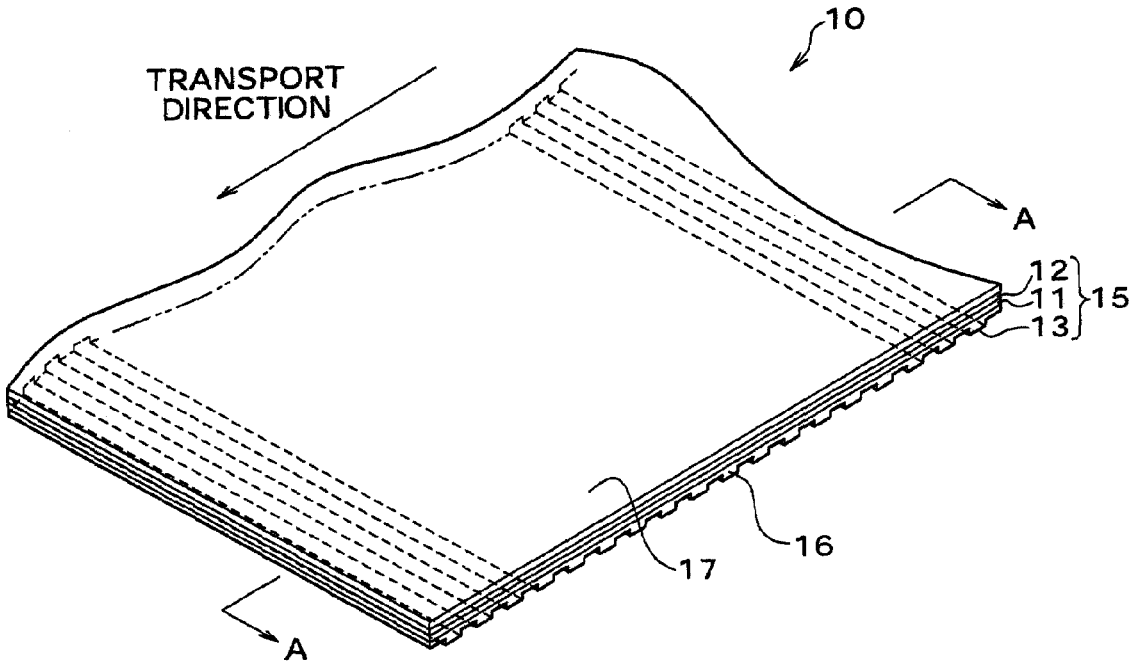
FIG. 1 is a perspective drawing showing an example of the inkjet recording medium of the present invention.

FIG. 1 is a perspective drawing showing an exemplary embodiment of the inkjet recording medium of the invention.

As shown in FIG. 1, in inkjet recording medium 10, long (continuous linear shape) concavities and convexities 16 are provided so that the linear direction of the concavities and convexities becomes orthogonal to the transport direction on the whole surface of one polyethylene layer 13 of polyethylene-coated paper 15 in which both faces of rectangle base paper 11 are coated with polyethylene layers 12 and 13, and ink-receiving layer 17 for receiving ink supplied from outside to carry out recording is provided on the other polyethylene layer 12.

Figure 2A:
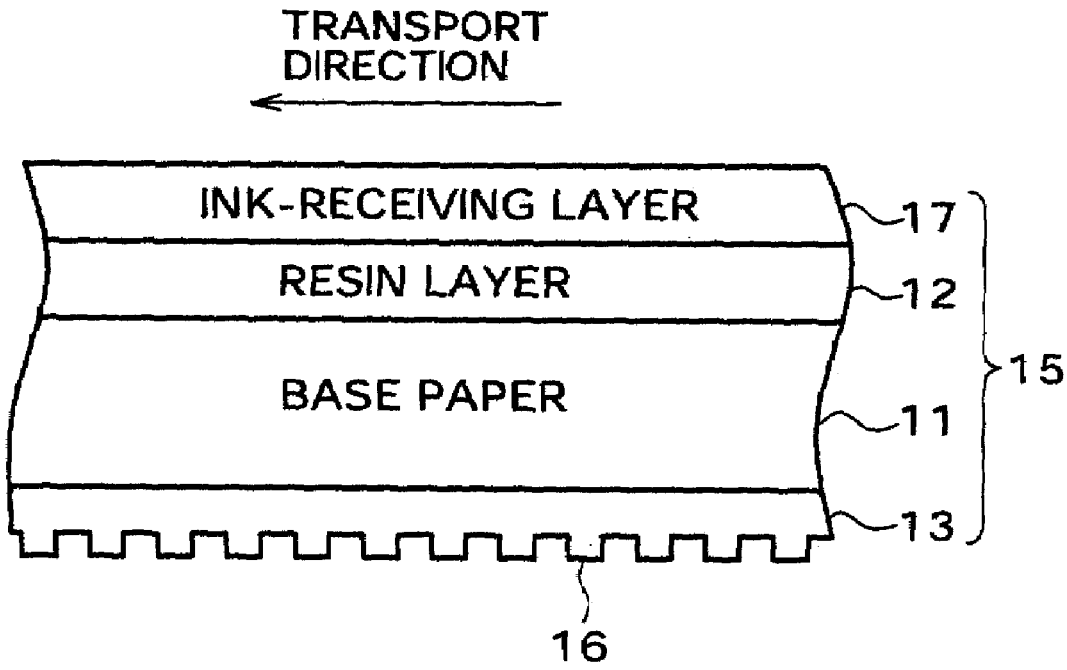
FIG. 2A is a cross-sectional drawing along A-A line of FIG. 1.
Figure 2B:
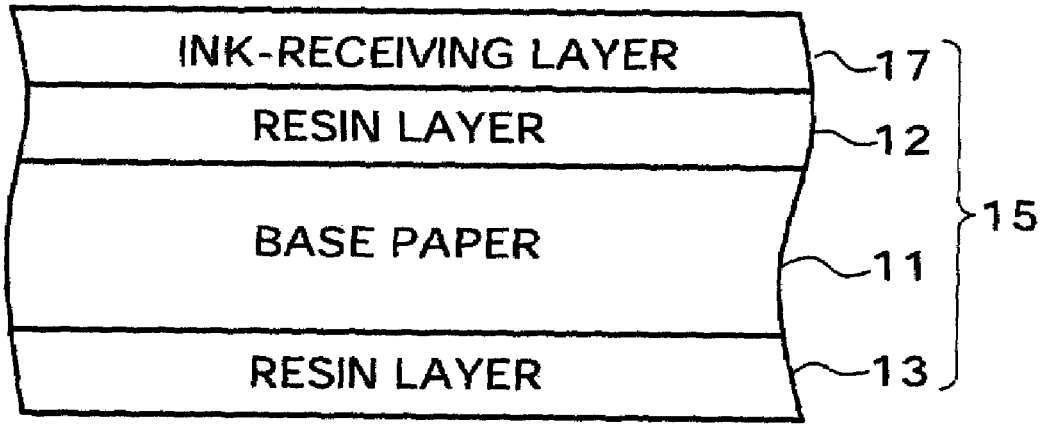
FIG. 2B is a cross-sectional drawing showing a cross-section obtained by cutting the inkjet recording medium of FIG. 1 along the plane surface orthogonal to the transport direction.

The cross-sectional structure of this inkjet recording medium 10 is enlarged and shown in FIGS. 2A and 2B. FIG. 2A is a cross-sectional drawing along A-A line of FIG. 1, which shows a cross-section obtained by cutting inkjet recording medium 10 to be transported along the plane surface parallel to the transport direction.

As shown in FIG. 2A, the support included in the inkjet recording medium 10 has a laminate structure in which both faces of base paper 11 are coated with polyethylene layers 12 and 13, and ink-receiving layer 17 is formed on one polyethylene layer 12 of these polyethylene layers, and concavities and convexities are formed on the other polyethylene layer 13. FIG. 2B is a cross-sectional drawing, which shows a cross-section (a cross-section orthogonal to the cross-section of FIG. 2A) obtained by cutting inkjet recording medium 10 to be transported along the plane surface orthogonal to the transport direction.

Hereinafter the resin-coated paper and ink-receiving layer included in the inkjet recording medium of the invention are mainly explained.

(Resin-Coated Paper)

The inkjet recording medium of the invention includes, as a support, resin-coated paper (e.g., in the form of rectangle (i.e., sheet type)) having at least one resin layer on each of both faces of base paper.

An inkjet recording medium including resin-coated paper tends to have bad brittleness of the ink-receiving layer when the recording medium is bent. However, in the present invention, since concavities and convexities are provided on the back face (which is not an inkjet recording surface of the resin-coated paper) so that the transport direction and the linear direction are orthogonal or approximately orthogonal as mentioned below, brittleness of the ink-receiving layer due to bending during transport through a curved transport pathway and bending during handling, specifically, breaking and cracking of the ink-receiving layer, can be alleviated.

The base paper for the resin-coated paper can be made using wood pulp as a main raw material, and optionally further using synthetic pulp such as polypropylene, or synthetic fiber such as nylon and polyester in addition to wood pulp. As wood pulp, any of LBKP, LBSP, NBKP, NBSP, LDP, NDP, LUKP and NUKP can be used, and it is preferable to use a larger amount of LBKP, NBSP, LBSP, NDP or LDP, which include much short fibers.

The ratio of LBSP and/or LDP is preferably 10% by mass or more, more preferably 10% by mass or more but 70% by mass or less.

As the pulp, chemical pulp (sulfate pulp or sulfite pulp) including low impurities is preferably used, and pulp bleached to enhance whiteness is also useful.

In the base paper, a sizing agent such as a higher aliphatic acid and an alkyl ketene dimer, a white pigment such as calcium carbonate, talc and titanium oxide, a paper strength enhancing agent such as starch, polyacrylamide and polyvinyl alcohol, a fluorescent brightening agent, a water retention agent such as polyethylene glycol, a dispersing agent, a softening agent such as quaternary ammonium can be suitably added.

The freeness of the pulp used for papermaking is preferably 200 to 500 ml under the regulation of CSF. Furthermore, the fiber length after beating is preferably 30 to 70% in total of 24 mesh residue % by mass and 42 mesh residue % by mass defined by JIS P-8207. The % by mass of 4 mesh residue is preferably 20% by mass or less.

The basis weight of the base paper is preferably 30 to 250 g, and specifically preferably 50 to 200 g. The thickness of the base paper is preferably 40 to 250 μm. High smoothness can be provided with the base paper by calendar treatment during or after papermaking. The density of base paper is generally 0.7 to 1.2 g/m$^2$ (JIS P-8118).

Furthermore, rigidness of the base paper is preferably 20 to 200 g under the condition as defined in JIS P-8143.

A surface sizing agent can be applied on the surface of the base paper. As the surface sizing agent, those similar to the sizing agent that can be added to the base paper can be used.

The pH of the base paper is preferably 5 to 9 when measured by a hot water extraction method as defined in JIS P-8113.

At least one resin layer is provided on the front face and reverse face of the base paper.

As a resin component for the resin layer, thermoplastic resins can be exemplified, and examples thereof may include styrene-butadiene latex, acrylic latex, acrylic silicone latex, polyolefin resins. Of these, polyolefin resins are preferable, and for example, α-olefin homopolymers such as polyethylene and polypropylene, and mixtures of these polymers, or a random copolymer of ethylene and vinyl alcohol are preferred.

As the polyethylene, for example, LDPE (low density polyethylene), HDPE (high density polyethylene), L-LDPE (linear low density polyethylene) can be used solely or as a mixture. When polyethylene is used, the melt flow rate before processing is preferably a value of 1.2 to 12 g/10 min that is measured according to JIS 7201.

When a polyolefin layer (e.g., a polyethylene layer) composed of a polyolefin (e.g., polyethylene) is provided on both faces of the base paper, the polyethylene layer on which an ink-receiving layer is to be formed preferably includes rutile or anatase-type titanium oxide, a fluorescent brightening agent, or ultramarine blue to so as to improve opaqueness, whiteness or hue as generally widely carried out in photographic paper. The content of titanium oxide is preferably about 3 to 20% by mass, more preferably 4 to 13% by mass relative to polyethylene.

Although the thickness of the polyolefin layer (e.g., polyethylene layer) is not specifically limited, and it is preferably 10 to 50 μm for both front and back faces.

Furthermore, an undercoating layer may be provided on the surface of the resin layer such as a polyethylene layer, specifically on the surface of the resin-coated paper on which an ink-receiving layer is to be provided, so as to improve adhesive property to the ink-receiving layer. The undercoating layer can be formed by applying and drying thereof in advance on the surface of the resin layer on the base paper prior to formation of an ink-receiving layer. The undercoating layer is a layer including, as a main component, a water-soluble polymer or a polymer latex, which is capable of forming a film. Preferably, water-soluble polymers such as an aqueous polyester, gelatin, polyvinyl alcohol, polyvinyl pyrrolidone and water-soluble cellulose are used. It is specifically preferably to form the layer using gelatin. The amount of the water-soluble polymer to be applied is preferably 10 to 500 m g/m$^2$, more preferably 20 to 300 mg/m$^2$. It is preferable that the undercoating layer further contains a surfactant or a film curing agent. Furthermore, it is preferable to carry out corona discharge treatment prior to formation (by application) of an undercoating layer on the resin-coated paper.

The thickness of the undercoating layer is preferably 0.01 to 5 μm.

The resin-coated paper in the invention may be polyolefin-coated paper (e.g., polyethylene-coated paper) in which front and back faces of base paper are coated with a thermoplastic resin such as a polyolefin (e.g., polyethylene), and can be used as gloss paper.

The resin-coated paper can be prepared by coating by melt extrusion, which includes casting a thermoplastic resin in heat-melted form on running base paper, so-called extrusion coating method.

Furthermore, it is preferable to carry out activation treatment such as corona discharge treatment and flame treatment on the base paper before coating the resin on the base paper. The resin-coated layer on the back face is generally a glossless surface, and where necessary, active treatment such as corona discharge treatment and flame treatment can be performed on the front face or on both front and back faces.

The back face of the resin-coated paper, which is the face opposite to the face on which the ink-receiving layer is provided, has linear concavities and convexities on the whole or a part of the back face so that their linear direction becomes parallel or approximately parallel to any one side (e.g., of four sides) of the resin-coated paper.

These linear concavities and convexities can be formed on the whole or a part of the back face of the resin-coated paper that does not have an inkjet recording surface, for example, by so-called embossing during coating by melt extrusion of a thermoplastic resin such as a polyolefin (e.g., polyethylene) on the base paper.

In the embossing, for example, a thermoplastic resin is heat melted in an extruder, and extruded in the form of film to between a base paper and a cooling roller to form a coating, and the thermoplastic resin coated on the back face is allowed to pass through between a pair of rollers to be pressed by the concavities and convexities surface of the cooling roller having a desired embossed shape on the surface of the roller, whereby desired concavities and convexities according to the concavities and convexities surface can be formed on the back face.

Examples of the method for providing a resin layer on the base paper include a method including applying an electron beam curable resin and irradiating electron beam, and a method including applying a coating liquid of a polyolefin resin emulsion, drying and surface smoothing treatment, in addition to the above-mentioned method including extruding heat melted resin. In any cases, resin-coated paper for the inkjet recording medium of the invention can be obtained by embossing using a roller having concavities and convexities.

In inkjet recording medium 10 as shown in FIG. 1, linear concavities and convexes in parallel to the short side of the four sides of the rectangle from one end to the other end of the short side are provided continuously along the long side direction, and the concavities and convexities have a rectangular shape at the cross-section that is cut at a plane surface parallel to the long side. The concavities and convexities have a shape rolling above and below by a pitch of $h^2$ and an amplitude of $w^2$ as shown in FIG. 3B, and occurrence of breaking or cracking of the ink-receiving layer when it is bent in the transport direction in the transport pathway can be avoided by the positional relationship in which the pitch direction is parallel to the transport direction during transport.

In the concavities and convexities, the pitch refers to the interval between the repeating mountain (convex) portion and valley (concave) portion, and the amplitude refers to the shortest distance (vertical distance) between the position at which the mountain portion and the valley portion are balanced and the position with the maximum displacement therefrom, i.e., half of the shortest distance (vertical distance) between the top position of the mountain and the bottom position of the valley.

Figure 3A:
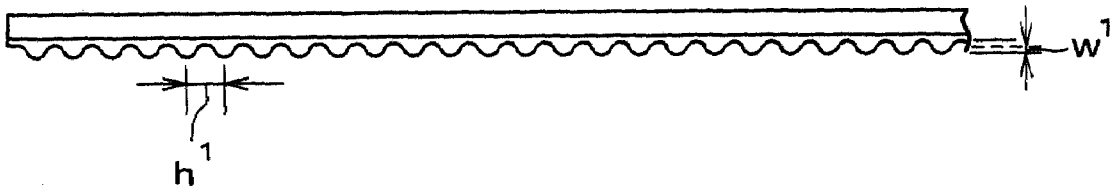
FIGS. 3A to 3D are cross-sectional drawings showing cross-section shapes of the concavities and convexities.
Figure 3B:
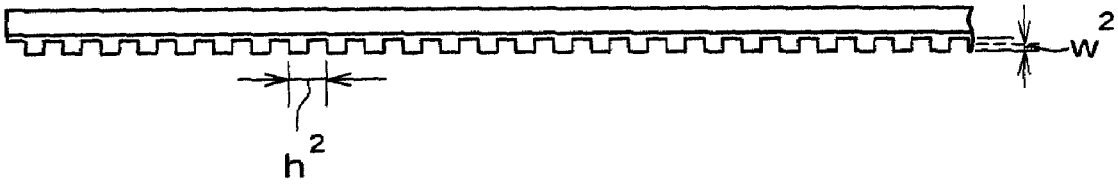
Figure 3C:
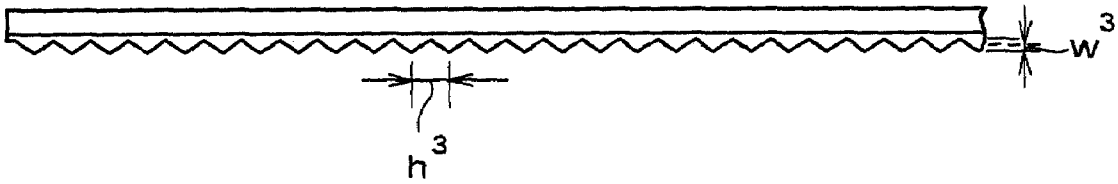
Figure 3D:
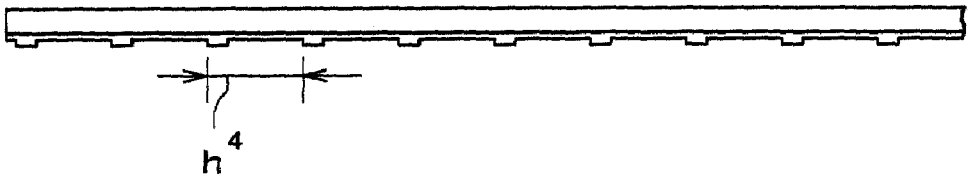

The concavities and convexities in the inkjet recording medium of the invention can be formed into a rectangular shape as shown in FIG. 3B, as well as into a wave shape having a pitch of $h^1$ and an amplitude of $w^1$, a triangular shape having a pitch of $h^3$ and an amplitude of $w^3$, and a rectangular shape having a pitch of $h^4$ and an amplitude of $w^4$ wherein the width of the concavities and the width of the convexities are different, as shown in FIGS. 3A, 3C and 3D, or into a shape having a combination of concavities of multiple shapes and convexes of multiple shapes with a periodicity.

Although the concavities and convexities are not specifically limited, it is specifically preferable that they are formed into rectangular shape, wave shape or triangular shape in view of quality and formability.

In the invention, although the pitch and amplitude of the concavities and convexities are not specifically limited and can be suitably selected according to the characteristic of the resin-coated paper, the characteristic of the ink-receiving layer, film thickness, and other various conditions, the pitch is preferably in the range of 100 to 4000 μm and the amplitude is preferably in the range of 2 to 100 μm in view of effect of alleviating brittleness and improvement of quality of the ink-receiving layer. Specifically, concavities and convexities having rectangular shape, wave shape or triangular shape wherein the pitch is in range of 200 to 2000 μm (more preferably 400 to 1000 μm) and the amplitude is in the range of 10 to 50 μm (more preferably 20 to 50 μm) are more preferable.

In inkjet recording medium 10 shown in FIG. 1, the case where the concavities and convexities are formed from one short side to the other short side is shown, but the concavities and convexities may be formed from one long side to the other long side according to the direction of bending due to the transport pathway or handling (specifically, in the case where the transport direction during transport does not cross the short side direction).

Furthermore, the concavities and convexities may not be formed in the form of continuous lines from one end to the other end of any one side of the resin-coated paper, and may be formed discontinuously, for example, to have one or more gaps or bending between one end and the other end. In the case where the concavities and convexities are formed linear, they may be formed in the form of straight lines in parallel to the short side as shown in FIG. 1, or may be provided with convexities and concavities such as wavy bending on the base paper.

The resin-coated paper may have a backcoat layer. The backcoat layer may contain, as components that can be added, a white pigment, an aqueous binder, as well as other components such as an anti-foaming agent, a form suppressing agent, a dye, a fluorescent brightening agent, a preservative agent and a waterproof agent.

Where the backcoat layer is provided, the above-mentioned concavities and convexities can be formed prior to or after formation of the backcoat layer.

Examples of the white pigment contained in the backcoat layer may include, for example, white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, halloysite hydrate, magnesium carbonate and magnesium hydroxide, organic pigments such as styrene-based plastic pigments, acrylic plastic pigments, polyethylene, microcapsules, urea resins and melamine resins.

Examples of the aqueous binder contained in the backcoat layer may include, for example, water-soluble polymers such as styrene/maleic acid salt copolymer, styrene/acrylic acid salt copolymer, polyvinyl alcohol, silanol modified polyvinyl alcohol, starch, cationized starch, casein, gelatin, carboxymethyl cellulose, hydroxyethyl cellulose and polyvinyl pyrrolidone, water-dispersion polymers such as styrene butadiene latex and acrylic emulsion.

(Ink-Receiving Layer)

One face of the resin-coated paper has at least one ink-receiving layer for receiving ink provided from outside. The ink-receiving layer can include at least inorganic microparticles and a water-soluble binder, and where necessary, other components such as a mordant and a crosslinking agent for curing a water-soluble resin by crosslinking.

—Inorganic Microparticles—

Examples of the inorganic microparticles include, for example, silica microparticles, colloidal silica, titanium dioxide, barium sulfate, calcium silicate, zeolite, kaolinite, halloysite, mica, talc, calcium carbonate, magnesium carbonate, calcium sulfate, pseudo boehmite, zinc oxide, zinc hydroxide, alumina, aluminum silicate, calcium silicate, magnesium silicate, zirconium oxide, zirconium hydroxide, cerium oxide, lanthanum oxide and yttrium oxide. Among these, silica microparticles, colloidal silica, alumina microparticles or pseudo boehmite is preferable from the viewpoint of forming a good porous structure. The microparticles may be used as primary particles, or in the form of secondary particles. The average primary particle diameter of these microparticles is preferably 2 μm or less, more preferably 200 nm or less.

Furthermore, silica microparticles having an average primary particle diameter of 20 nm or less, colloidal silica having an average primary particle diameter of 30 nm or less, alumina microparticles having an average primary particle diameter of 20 nm or less, or pseudo boehmite having an average micropore diameter of 2 to 15 nm are more preferable, and silica microparticles, alumina microparticles and pseudo boehmite are specifically preferable.

Silica microparticles are broadly divided into wet method particles and dry method (vapor-phase method) particles according to the production method therefor. In the wet method, a mainstream method is one including decomposing a silicate salt with an acid to form an active silica, suitably polymerizing the active silica and precipitating it by aggregation to give hydrous silica. On the other hand, mainstream vapor-phase methods are a method including hydrolyzing a halogenated silicon by high temperature vapor phase hydrolysis (flame hydrolysis method), and a method including vaporizing quartz sand and coke by heat reduction using arc in an electrical furnace and oxidizing them by air (arc method), thereby obtaining anhydrous silica. The "vapor-phase method silica" refers to anhydrous silica microparticles obtained by the vapor-phase method.

As the silica microparticles, vapor-phase method silica microparticles are specifically preferable.

The vapor-phase method silica is different from hydrous silica in a density of silanol groups on the surface, and presence or absence of pores, and shows different property, and is suitable for forming a three-dimensional structure having a high porosity. Although the reason is not clear, it is presumed that hydrous silica has a high density of silanol groups on the surface of the microparticles of 5 to 8 groups/nm$^2$, which tends to result in tight aggregation of silica microparticles, whereas vapor-phase method silica has a low density of silanol groups on the surface of the microparticles of 2 to 3 groups/nm$^2$, which results in poor and soft aggregate (flocculate) and forms a structure having a high porosity.

Since the vapor-phase method silica has specifically a large specific surface area, it has high ink absorbing property and high efficiency of retention. Furthermore, since the vapor-phase method silica has low refractive index, transparency can be provided with the ink-receiving layer and high color density and good color-developing property can be obtained by dispersing it to a suitable particle diameter. It is important for the ink-receiving layer to be transparent in view of achieving high color density, good color-developing property and glossiness in applications in which transparency is required, such as OHP, as well as applications in sheets for recording such as gloss paper for photographs.

The average primary particle diameter of the inorganic microparticles (e.g., vapor-phase method silica) is preferably 50 nm or less, more preferably 3 to 50 nm, further preferably 3 to 30 nm, specifically preferably 3 to 20 nm, and most preferably 3 to 10 nm in view of quick drying property (ink absorbing velocity). Since particles of vapor-phase method silica are easy to adhere each other by hydrogen bonding of silanol groups, the average primary particle diameter of vapor-phase method silica is preferably 50 nm or less because a structure having a high porosity can be formed and ink absorbing property can be effectively improved.

Moreover, the vapor-phase method silica may be used in combination with other inorganic microparticles mentioned above. Where other microparticles and the vapor-phase method silica are used in combination, the content of the vapor-phase method silica in the whole microparticles is preferably 30% by mass or more, more preferably 50% by mass or more.

As inorganic microparticles, alumina microparticles, alumina hydrate, or mixture or complex thereof are preferable. Among these, alumina hydrate is preferable since it absorbs and stabilizes ink well, and pseudo boehmite ($Al_2O_3.nH_2O$) is specifically preferable. Although various forms of alumina hydrate can be used, it is preferable to use sol-type boehmite as a raw material because a smooth layer can be readily obtained.

For the micropore structure of pseudo boehmite, the average micropore diameter is preferably 1 to 30 nm, more preferably 2 to 15 nm. Furthermore, the micropore volume is preferably 0.3 to 2.0 cc/g, more preferably 0.5 to 1.5 cc/g. The micropore diameter and micropore volume are measured by nitrogen adsorption-desorption method, and for example, can be measured by a gas adsorption-desorption analyzer (e.g., trade name: OMNISOAP 369, manufactured by Coulter Ltd.).

Among the alumina microparticles, vapor-phase method alumina microparticles are preferable because of large specific surface area. The average primary particle diameter of vapor-phase method alumina is preferably 30 nm or less, more preferably 20 μm or less.

Where inorganic microparticles are used for the inkjet recording medium, for example, those disclosed in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777, 2001-301314 are also preferably used.

—Water-Soluble Binder—

Examples of the water-soluble binder include, for example, polyvinyl alcohol resins that are resins having hydroxy groups as hydrophilic structure units [e.g., polyvinyl alcohol (PVA), acetoacetyl modified polyvinyl alcohol, cationic modified polyvinyl alcohol, anionic modified polyvinyl alcohol, silanol modified polyvinyl alcohol, polyvinylacetal], cellulose resins [e.g., methylcellulose (MC), ethylcellulose (EC), hydroxyethylcellulose (HEC), carboxymethyl cellulose (CMC), hydroxypropylcellulose (HPC), hydroxyethylmethyl cellulose, hydroxypropylmethylcellulose], chitins, chitosans, starch, resins having ether bonds [polyethyleneoxide (PEO), polypropyleneoxide (PPO), polyethyleneglycol (PEG), polyvinylether (PVE)], resins having carbamoyl group [e.g., polyacrylamide (PAAM), polyvinyl pyrrolidone (PVP), polyacrylic acid hydrazide].

In addition, polyacrylic acid salts having carboxyl groups as dissociatable groups, maleic acid resins, alginic acid salts, gelatins can also be exemplified.

Among the above-mentioned ones, polyvinyl alcohol resins are specifically preferable. Examples of polyvinyl alcohols may include those described in Japanese Patent Application Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345, 8-324105 and 11-348417.

Furthermore, examples of the water-soluble binders other than polyvinyl alcohol resins may include compounds described in paragraphs [0011] to [0014] of JP-A No. 11-165461.

These water-soluble binders may be used solely or as a combination of two kinds or more.

The content of the water-soluble binder in the invention is preferably 9 to 40% by mass, more preferably 12 to 33% by mass relative to whole solid mass of the ink-receiving layer.

The inorganic microparticles and water-soluble binder, which are main components of the ink-receiving layer, may be each a single material or a combination of multiple materials.

In view of retention of transparency, the kind of the water-soluble binder to be combined with inorganic microparticles, specifically silica microparticles, may be important. Where vapor-phase method silica is used, polyvinyl alcohol resins are preferable as the water-soluble binder. Among them, polyvinyl alcohol resins having a saponification degree of 70 to 100% are more preferable, and polyvinyl alcohol resins having a saponification degree of 80 to 99.5% are specifically preferable.

Polyvinyl alcohol resin has hydroxyl groups in its structure units, and the hydroxyl groups and silanol groups on the surface of the silica microparticles form hydrogen bonds, which allows easy formation of a three-dimensional network structure including secondary particles of the silica microparticles as network chain units. It is considered that an ink-receiving layer of porous structure having a high porosity and a sufficient strength is formed due to formation of the three-dimensional network structure.

During inkjet recording, the porous ink-receiving layer obtained as above rapidly absorbs ink by capillary phenomenon, whereby dots having a fine perfect circularity can be formed without bleeding of ink.

Alternatively, a polyvinyl alcohol resin and the above-mentioned other water-soluble binder may be used in combination. In the case where the other water-soluble binder and the polyvinyl alcohol resin are used in combination, the content of the polyvinyl alcohol resin is preferably 50% by mass or more, more preferably 70% by mass or more in the whole water-soluble binder.

—Content Ratio of Inorganic Microparticles and Water-Soluble Binder—

Mass content ratio [PB ratio (x/y)] of the inorganic microparticles (x) and the water-soluble binder (y) remarkably affects the film structure and film strength of the ink-receiving layer. Namely, where the mass content ratio [PB ratio] increases, porosity, micropore volume, surface area (per unit mass) are increased, whereas density and strength tend to be decreased. The PB ratio (x/y) of the ink-receiving layer is preferably 1.5 to 10 in view of prevention of decrease in film strength and cracking under drying due to too high PB ratio, and in view of prevention of decrease in ink absorption property due to too small PB ratio that causes easy clogging of pores with the resin and low porosity.

Where the inkjet recording medium of the invention is transported through a transport system in an inkjet printer, bending stress is sometimes applied to the recording medium. Therefore, it is desirable that the ink-receiving layer has a higher film strength. Furthermore, it is necessary to provide a high film strength with the ink-receiving layer in order to prevent breaking and peeling of the ink-receiving layer during cutting into sheets. Taking these cases in consideration, the PB ratio (x/y) is more preferably 5 or less, and 2 or more in view of ensuring high-speed absorption property of ink in an inkjet printer.

For example, where a coating liquid in which vapor-phase method silica microparticles having an average primary particle diameter of 20 μm or less and a water-soluble binder are completely dispersed in an aqueous solution at the PB ratio (x/y) of 2 to 5 is applied on a support and dried to form an ink-receiving layer, a three-dimensional network structure having secondary particles of the vapor-phase method silica as network chains is formed, and a translucent porous film having an average micropore diameter of 30 nm or less, a porosity of 50 to 80%, a micropore volume of 0.5 ml/g or more, and a specific surface area of 100 $m^2/g$ or more can be readily formed.

—Other Components—

<Crosslinking Agent>

Where the ink-receiving layer contains the above-mentioned water-soluble binder, an embodiment wherein the ink-receiving layer contains a crosslinking agent capable of crosslinking the water-soluble binder, and is a porous layer cured by crosslinking reaction of the crosslinking agent with the water-soluble binder is preferable.

For crosslinking the water-soluble binder, specifically a polyvinyl alcohol resin, boron compounds are preferable. Boron compounds may include, for example, borax, boric acid, boric acid salt (e.g., orthoborate, $InBO_3$, $ScBO_3$, $YBO_3$, $LaBO_3$, $Mg_3(BO_3)_2$, $CO_3(BO_3)_2$, diborate (e.g., $Mg_2B_2O_5$, $CO_2B_2O_5$), metaborate (e.g., $LiBO_2$, $Ca(BO_2)_2$, $NaBO_2$, $KBO_2$), tetraborate (e.g., $Na_2B_4O_7.10H_2O$) and pentaborate (e.g., $KB_5O_8.4H_2O$, $Ca_2B_6O_{11}.7H_2O$, $CsB_5O_5$). Among these, borax, boric acid, boric acid salt are preferable, specifically boric acid is preferable for quick crosslinking reaction.

As the crosslinking agent, the following compounds other than boron compounds can also be used. Examples include aldehyde compounds such as formaldehyde, glyoxal and glutaraldehyde; ketone compounds such as diacetyl and cyclopentanedione; active halogen compounds such as bis(2-chloroethylurea), 2-hydroxy-4,6-dichloro-1,3,5-triazine and 2,4-dichloro-6-S-triazine sodium salt; active vinyl compounds such as divinyl sulfonic acid, 1,3-vinylsulfonyl-2-propanol, N,N'-ethylenebis (vinyl sulfonyl acetamide) and 1,3,5-triacryloy-hexahydro-5-triazine; N-methylol compounds such as dimethylol urea and methylol dimethylhydantoin; melamine resins (e.g., methylol melamine, alkylated methylol melamine); epoxy resin; isocyanate compounds such as 1,6-hexamethylenediisocyanate; aziridine compounds described in U.S. Pat. Nos. 3,017,280 and 2,983,611; carboximide compounds described in U.S. Pat. No. 3,100,704; epoxy compounds such as glycerol triglycidyl ether; ethyleneimino compounds such as 1,6-hexamethylene-N,N'-bisethyleneurea; halogenated carboxyaldehyde compounds such as mucochloro acid and mucophenoxy chloro acid; dioxane compounds such as 2,3-dihydroxydioxane; metal-containing compounds such as titanium lactate, aluminum sulfate, chromium alum, potassium alum, zirconyl acetate and chromium acetate; polyamine compounds such as tetraethylene pentamine; hydrazide compounds such as adipic acid dihydrazide; and low molecules or polymers containing two or more oxazoline groups. The crosslinking agents may be used solely or a combination of two or more kinds.

The amount of the crosslinking agent is preferably 1 to 50% by mass relative to the water-soluble binder.

<Cationic Polymer>

The ink-receiving layer may contain a cationic polymer in order to obtain an effect for improving ozone resistance. Although the cationic polymer is not specifically limited, cationic polymers having I/O value of 3 or more (preferably 4 or more) are preferable. Here, the I/O value refers to a value obtained by dividing an inorganic group value with an organic group value based on the Organic Conception Diagram. The I/O value can be obtained according to the method described in "Organic Conception Diagram—Basis and Application—" (1984) (Yoshio Koda, Sankyo Publishing Co., Ltd.).

Specific examples of the cationic polymer may include the cationic polymers described in the section of "Mordant" mentioned below and polyalkylamine epichlorohydrin condensed polymers, and polyalkylamine epichlorohydrin condensed polymers are preferable in view of an effect for improving ozone resistance.

The content of the cationic polymer in the ink-receiving layer is preferably 0.01 g/m$^2$ to 2.0 g/m$^2$ in view of an effect for improving ozone resistance.

<Mordant>

The ink-receiving layer may contain a mordant for the purpose of improving water resistance and bleeding over time of an image. When a mordant is added to the ink-receiving layer, it reacts with liquid ink that has an anionic dye as a colorant and stabilizes the colorant, whereby waterproof property and bleeding over time can be improved.

Examples of the mordant may include cationic polymers (cationic mordants) that are organic mordants, or inorganic mordants.

Examples of the cationic mordant may include polymeric mordants having primary to tertiary amino groups or quaternary ammonium salt groups as cationic groups, or cationic non-polymeric mordants. Examples of the polymer mordants may include homopolymers of monomers (mordant monomers) having primary to tertiary amino groups or salts thereof, or quaternary ammonium salt groups, or copolymers or condensed polymers of mordant monomers and other monomers (hereinafter referred to as "non-mordant monomers"). These polymeric mordants can be used in the form of either a water-soluble polymer or water-dispersible latex particles.

Details of the monomers (mordant monomers), non-mordant monomers and other mordants are described in the paragraphs [0058] to [0067] of JP-A No. 2007-185884.

Other than those described above, cationic, anionic, nonionic, amphoteric, fluoro and silicone surfactants may be used for the ink-receiving layer. Surfactants are described in the paragraphs [0068] to [0074] of JP-A No. 2007-185884.

In addition, the ink-receiving layer may include an organic solvent having a high boiling point so as to prevent curling.

The organic solvent having a high boiling point is a water-soluble or hydrophobic organic compound having a boiling point of 150° C. or more at ordinary pressure, which may be liquid or solid at room temperature, and may be a low molecule or a polymer. Specific examples may include aromatic carboxylic acid esters (e.g., dibutyl phthalate and diphenyl phthalate, phenyl benzoate), aliphatic carboxylic acid esters (e.g., dioctyl adipate, dibutyl sebacate, methyl stearate, dibutyl maleate, dibutyl fumarate and triethyl acetylcitrate), phosphate esters (e.g., trioctyl phosphate and tricresyl phosphate), epoxys (e.g., epoxidized soybean oil and epoxidized fatty acid methyl ester), alcohols (e.g., stearyl alcohol, ethylene glycol, propylene glycol, diethylene glycol, triethylene glycol, glycerine, diethylene glycol monobutyl ether (DEGMBE), triethyleneglycol monobutyl ether, glycerine monomethyl ether, 1,2,3-butanetriol, 1,2,4-butanetriol, 1,2,4-pentanetriol, 1,2,6-hexanetriol, thiodiglycol, triethanolamine and polyethylene glycol), vegetable oils (e.g., soybean oil and sunflower oil) and higher aliphatic carboxylic acid (e.g., linoleic acid and oleic acid).

The inkjet recording medium of the invention can be prepared by applying a preparation liquid for forming an ink-receiving layer on the face opposite to the face of the resin-coated paper on which concavities and convexities are formed, and drying to form an ink-receiving layer.

Alternatively, the inkjet recording medium of the invention may be prepared by, for example, a method including applying a preparation liquid A containing at least inorganic microparticles and a water-soluble binder on the face opposite to the face of the resin-coated paper on which concavities and convexities are formed, applying a basic solution having a pH of 7.1 or more (solution B) either (a) simultaneously with formation of the applied layer by the application, or (b) during drying of the applied layer by the application but before the applied layer shows falling rate drying, to crosslink and cure the applied layer on which the solution B is applied. The crosslinking agent may be added to at least one of the preparation liquid A containing at least inorganic microparticles or the solution B. This case is preferable in view of not only excellent ink absorption property but also of prevention of breaking or cracking of the layer since the ink-receiving layer can be made porous and be crosslinked and cured by addition of the solution B. Therefore, where the ink-receiving layer is provided in combination with the resin-coated paper in the invention, breaking and cracking of the ink-receiving layer can be alleviated, and brittleness of the ink-receiving layer can be further improved.

The preparation liquid for forming the ink-receiving layer, which contains inorganic microparticles (e.g., vapor-phase method silica) and a water-soluble binder (e.g., polyvinyl alcohol), can be prepared, for example, as follows.

Namely, it can be prepared by adding inorganic microparticles such as vapor-phase method silica and a dispersing agent to water (e.g., silica microparticles in water are 10 to 20% by mass), dispersing the mixture using a bead mill (e.g., trade name: KD-P, manufactured by Shima Enterprize), under the condition of, for example, high-speed rotation at 10000 rpm (preferably at 5000 to 20000 rpm) for, for example, 20 minutes (preferably 10 to 30 minutes), adding an aqueous solution of polyvinyl alcohol (PVA) (e.g., so that PVA becomes one third of the vapor-phase method silica by mass), and carrying out dispersing under the same rotation condition as mentioned above. In order to provide stability with the coating liquid, it is preferable to adjust the pH to about 9.2 using aqueous ammonia, or to use a dispersing agent. The obtained coating liquid is in the form of uniform sol, and a porous ink-receiving layer having a three-dimensional network structure can be formed by applying the liquid on the resin-coated paper and drying.

An aqueous dispersion including vapor-phase method silica and a dispersing agent may be prepared by preparing an aqueous dispersion of vapor-phase method silica in advance and adding the dispersion to the aqueous solution of the dispersing agent, or adding the aqueous solution of the dispersing agent to the aqueous solution of the vapor-phase method silica, or simultaneously mixing them. Alternatively, powdery vapor-phase method silica may be added to the aqueous solution of the dispersing agent instead of using the aqueous dispersion of vapor-phase method silica.

The vapor-phase method silica and the dispersing agent are mixed, and the mixed liquid is disintegrated by using a disperser, whereby an aqueous dispersion having an average particle diameter of 50 nm or less can be obtained.

As the solvent for each step, water, organic solvents, or mixed solvents thereof can be used. The organic solvents that can be used for the application may be alcohols such as methanol, ethanol, n-propanol, i-propanol and methoxypropanol, ketones such as acetone and methylethylketone, tetrahydrofuran, acetonitrile, ethyl acetate, and toluene.

Furthermore, a dispersing agent may be added so as to improve the dispersing property of the coating liquid. The dispersing agent is not specifically limited, and known cationic resins can be used. The amount of the dispersing agent to be added relative to the inorganic microparticles is preferably 0.1% to 30%, more preferably 1% to 10%.

Application can be carried out by, for example, known application methods such as an extrusion die coater, an air doctor coater, a bread coater, a rod coater, a knife coater, a squeeze coater, a reverse roll coater and a bar coater.

The solution B is added to the applied layer simultaneously with application of the preparation liquid A, or during drying of the applied layer formed by application of the preparation liquid A but before the applied layer shows falling rate drying. Namely, the solution B is introduced after application of the preparation liquid A but during constant ratio drying of the applied layer, whereby a porous layer cured by crosslinking can be suitably prepared.

Where necessary, the solution B can contain a crosslinking agent, a mordant or the like.

Curing of a film can be accelerated by using the solution B as an alkaline solution, and the solution B is adjusted to preferably pH 7.1 or more, more preferably pH 7.5 or more, and specifically preferably pH 7.9 or more. Where the pH is within the range, crosslinking reaction of the water-soluble binder in the preparation liquid A is carried out well, which is suitable for preventing generation of bronzing and prevention of generation of cracking on the ink-receiving layer.

In the above-mentioned method, "before the applied layer shows falling rate drying" generally refers to the period from immediately after application of the coating liquid to several minutes after, and during this period, a phenomenon of "constant ratio drying" in which the content of the solvent (dispersion medium) in the applied layer decreases in proportion to time. The period in which "constant ratio drying" is observed is described, for example, in the Chemical Engineering Handbook (pages 707 to 712, published by Maruzen Co. Ltd., Oct. 25, 1980).

During this period, drying can be carried out generally at the temperature area of 40 to 180° C. for 0.5 to 10 minutes (preferably 0.5 to 5 minutes). Although the drying time naturally differs according to the amount applied, the above-mentioned range is usually suitable.

According to the above-mentioned invention, an inkjet recording medium in which quality is maintained and brittleness against bending is improved can be provided.

Exemplified embodiments of the invention are as follows.

<1> An inkjet recording medium comprising a resin-coated paper comprising a base paper and at least one resin layer on each of both faces of the base paper, and an ink-receiving layer on one face of the resin-coated paper, wherein the inkjet recording medium comprises linear concavities and convexities that are formed in parallel or approximately parallel to any one side of the resin-coated paper on at least a part of the face of the resin-coated paper on which the ink-receiving layer is not formed.

<2> The inkjet recording medium according to <1>, wherein the linear concavities and convexities are formed at a predetermined pitch in a direction orthogonal to the linear direction of the concavities and convexities.

<3> The inkjet recording medium according to <1>, wherein a cross-section of the recording medium along a direction orthogonal to the linear direction of the linear concavities and convexities has a rectangular shape, a wave shape or a triangular shape.

<4> The inkjet recording medium according to <1>, wherein the linear concavities and convexities are formed in parallel or approximately parallel to a direction orthogonal to a transport direction in which the medium is transported during recording.

<5> The inkjet recording medium according to <1>, wherein a thickness of the base paper is 40 to 250 μm.

<6> The inkjet recording medium according to <1>, wherein the resin layer comprises a thermoplastic resin.

<7> The inkjet recording medium according to <1>, wherein the resin layer comprises a polyolefin resin.

<8> The inkjet recording medium according to <1>, wherein a thickness of the resin layer is 10 to 50 μm.

<9> The inkjet recording medium according to <9>, wherein the ink-receiving layer comprises inorganic particles and a water-soluble binder.

<10> The inkjet recording medium according to <9>, wherein the inorganic particles comprise silica, alumina or pseudo boehmite.

<11> The inkjet recording medium according to <1>, wherein the water-soluble binder comprises a polyvinyl alcohol resin.

EXAMPLES

Hereinafter the present invention is explained in more detail with referring to Examples, but the invention should not be construed to be limited to the following Examples. Unless specifically mentioned, the "parts" is based on a mass basis.

Example 1

Preparation of Support

LBKP derived from acacia (50 parts) and LBKP derived from aspen (50 parts) were each processed by beating in a disc refiner until the Canadian Freeness became 300 ml to prepare pulp slurry.

To the obtained pulp slurry were then added, relative to the pulp, 1.3% of cationic starch (trade name: CATO 304L, manufactured by Nippon NSC Ltd.), 0.15% of anionic polyacrylamide (trade name: DA4104, manufactured by Seiko PMC Corporation), 0.29% of alkylketene dimer (trade name: SIZEPINE K, manufactured by Arakawa Chemical Indusries, Ltd.), 0.29% of epoxidized behenic acid amide, and 0.32% of polyamidepolyamine epichlorohydrin (trade name: ARAFIX 100, manufactured by Arakawa Chemical Indusries, Ltd.). Then, 0.12% of an anti-foaming agent was added thereto.

Papermaking was carried out with the pulp slurry prepared as above using a Fourdriner paper machine, and the paper was dried by a drying step in which the felt surface of the web was pressed on a dram dryer cylinder via a dryer canvas, with a tension of a dryer canvas of 1.6 kg/cm. Thereafter, the base paper was subjected to size press coating of a polyvinyl alcohol (trade name: KL-118, manufactured by Kuraray Co, Ltd.) on both surfaces thereof at a rate of 1 g/m$^2$, dried and calendar processed. The base paper manufactured had a basis weight of 166 g/m$^2$ and a thickness of 160 μm.

The wire surface (back face) of the obtained base paper was subjected to corona discharge treatment, and a high density polyethylene was coated thereon using a melt extruder so that the thickness became 30 μm to form a thermoplastic resin layer (hereinafter the surface of this thermoplastic resin layer is referred to as "back face"). The thermoplastic resin layer on the back face was further subjected to corona discharge treatment, and a dispersion liquid as an antistatic agent in which aluminum oxide (trade name: ALUMINA SOL 100, manufactured by Nissan Chemical Industries, Ltd.) and silicone dioxide (trade name: SNOWTEX O, manufactured by Nissan Chemical Industries, Ltd.) had been dispersed in water by the mass ratio of 1:2 was applied so that the drying mass became 0.2 g/m$^2$.

The base paper was then transported in the direction parallel to its long side. At that time, the base paper was passed between a pair of rollers consisting of a heating roller for embossing in which the roller surface (curved surface) at the cross-section along the plane surface orthogonal to the roller shaft center was embossed in saw-toothed triangle waveform, and a roller which was pressed against the heating roller for embossing. Thus, the thermoplastic resin layer on the back face of the base paper was embossed by the heating roller for embossing, as shown in FIG. 3C, so as to have concavities and convexities having triangle waveform having an amplitude of the concavities and convexities (amplitude of the triangle waveform at the cross-section along the plane surface parallel to the long side of base paper; $w^3$) of 50 μm, and a pitch (pitch of the concavities and convexities in the direction parallel to the long side of base paper; $h^3$) of 0.5 mm.

Herein, the amplitude $w^3$ of the concavities and convexities refers to, as shown in FIG. 3C, half of the shortest distance between the highest part and the lowest part of the triangle waveform.

Furthermore, the felt surface on which a thermoplastic resin layer was not provided was subjected to corona discharge treatment. Then, a low density polyethylene having an MFR (melt flow rate) of 3.8 which contained 10% of anatase type titanium dioxide, 0.3% of ultramarine blue (manufactured by Tokyo Printing Ink MFG Co., Ltd.), and 0.08% of a fluorescent brightening agent (trade name: WHITE FLOUR PSN CONC, manufactured by Nippon Chemical Works Co., Ltd.) was extruded thereon using an extruder so that the thickness became 25 μm to form a high glossiness thermoplastic resin layer on the felt surface of the base paper (hereinafter this high glossiness surface is referred to as "front face") to give a support. This support was cut into a long roll having a width of 1.5 m and a roll length of 3000 m.

—Preparation of Liquid for Forming Ink-Receiving Layer—

From the components of the following composition, (1) vapor-phase method silica microparticles, (2) ion exchanged water, (3) Sharoll DC-902P and (4) ZA-30 were mixed, and the mixture was dispersed using a bead mill (trade name: KD-P, manufactured by Shinmaru Enterprizes Corporation), and the dispersion liquid was heated to 45° C. and retained for 20 hours. To this dispersion liquid were then added the following (5) boric acid, (6) polyvinyl alcohol solution, (7) Superflex 600 and (8) ethanol at 30° C. to prepare a liquid for forming ink-receiving layer.

The mass ratio of the silica microparticles and the water-soluble binder (PB ratio=(1):(6)) was 4.45:1, and the pH of the liquid for forming ink-receiving layer was 3.8 (acidic).

<Composition of Liquid for Forming Ink-Receiving Layer>

(1) Vapor-phase method silica microparticles (inorganic microparticles) . . . 8.9 parts (trade name: AEROSIL300SF75, manufactured by Nippon Aerosil Co., Ltd.)

(2) Ion exchanged water . . . 51.4 parts (3) Dispersing agent (51.5% aqueous solution) . . . 0.78 parts (trade name: SHAROLL DC-902P, manufactured by Daiichi Kogyo Seiyaku Co., Ltd.)

(4) ZA-30 (trade name, manufactured by Daiichi Kigenso Kagaku Kogyo Co., Ltd.) . . . 0.48 parts (5) Boric acid (crosslinking agent) . . . 0.33 parts (6) Polyvinyl alcohol (water-soluble binder) solution . . . 28.6 parts

[Composition of the Solution]

PVA-235 (manufactured by Kuraray Co, Ltd.; saponification degree 88%, polymerization degree 3500) . . . 2.0 parts Ion exchanged water . . . 26.6 parts (7) Superflex 600 . . . 1.11 parts (trade name, manufactured by Daiichi Kogyo Seiyaku Co., Ltd.)

(8) Ethanol . . . 4.1 parts

—Preparation of Inkjet Recording Medium—

The front face of the long roll (support) obtained as above was subjected to corona discharge treatment. Then, the liquid for forming ink-receiving layer was flowed (173 cc/m$^2$) and the mordant mixed solution mentioned below was mixed thereto at a velocity of 10.8 ml/m$^2$ to prepare a coating liquid (first liquid) while the coating liquid (first liquid) was applied on the front face of the support. The applied layer was dried using a heat-wind drier at 80° C. at a wind velocity of 3 to 8 m/sec until the concentration of the solid contents in the applied layer became 24%. During this period, the applied layer showed constant ratio drying. Immediately after that, the layer was soaked into the second liquid having the following composition for 3 seconds to adhere 13 g/m$^2$ of the second liquid on the applied layer, and dried at 72° C. for 10 minutes.

Thus, a sheet for inkjet recording having an ink-receiving layer with a dry film thickness of 32 μm was obtained.

<Composition of Mordant Mixed Solution>

(1) Basic polyaluminum hydroxide compound . . . 4.0 parts (trade name: ALFINE 83, manufactured by Taimei Chemicals Co., Ltd.)

(2) Ion exchanged water . . . 4.6 parts (3) Polyoxyethylene lauryl ether (surfactant) . . . 0.7 parts (trade name: EMULGEN 109P, manufactured by Kao Corporation, 10% aqueous solution, HLB value 13.6)

(4) Cationic polymer . . . 0.7 parts (trade name: HIGHMAX SC-505, manufactured by Hymo Co., Ltd.)

<Composition of Second Liquid>

(1) Boric acid . . . 0.65 parts (2) Ammonium carbonate (first grade: manufactured by Kanto Chemical Co., Ltd.) . . . 4.0 parts (3) Ion exchanged water . . . 89.4 parts (4) Polyoxyethylene lauryl ether (surfactant) . . . 6.0 parts (trade name: EMULGEN 109P, manufactured by Kao Corporation, 10% aqueous solution, HLB value 13.6)

Example 2

A sheet for inkjet recording was prepared in a manner similar to Example 1 except that the concavities and convexities formed on the back face by embossing were changed those having rectangular wave shape with amplitude ($w^2$) of 50 μm and pitch ($h^2$) of 1 mm, as shown in FIGS. 1 and 3B.

Example 3

A sheet for inkjet recording was prepared in a manner similar to Example 1 except that the concavities and convexities formed on the back face by embossing were changed those having sinusoidal waveform with an amplitude ($w^1$) of 20 μm and a pitch ($h^1$) of 0.5 mm, as shown in FIG. 3A.

Comparative Example 1

Figure 4:
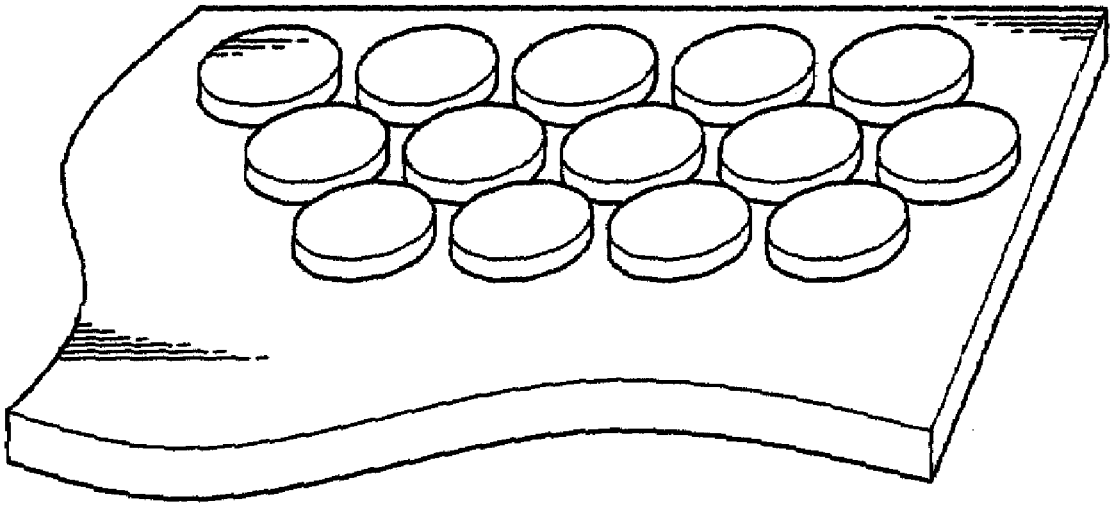
FIG. 4 is a schematic perspective drawing showing a sheet for inkjet recording of Comparative Example 1, which has an embossed back face.

A sheet for inkjet recording of a comparative example was prepared in a manner similar to Example 1 except that cylinders each having a diameter of 1 mm and a height of 20 μm were formed by embossing at a density of 250,000 cylinders/$m^2$ as shown in FIG. 4 instead of embossing to form concavities and convexities on the back face as in Example 1.

Comparative Example 2

A sheet for inkjet recording of a comparative example was prepared in a manner similar to Example 1 except that concavities and convexities were not formed on the back face by embossing.

(Evaluation)

—1. Brittleness—

The sheets for inkjet recording obtained in the above-mentioned Examples and Comparative Examples were each set on a printer (tread name: Photosmart C5175, manufactured by Hewlett-Packard Japan Ltd.). The sheets were A4 size, and each 10 sheets were set and left overnight under an environment of 10° C. and 20% RH. Thereafter a black solid image was printed, the printed sheet was visually confirmed, and the degree of cracking was evaluated according to the following evaluation criteria.

<Evaluation Criteria>

Rank 4: No cracking was observed.

Rank 3: Indistinctive cracking was generated with very little frequency, which did not interfere with practical use.

Rank 2: Slight cracking was observed, which was not acceptable in view of quality.

Rank 1: Frequency of cracking was high or degree of cracking was bad, and quality was significantly deteriorated.

—2. Transportability—

For the sheets for inkjet recording obtained in the above-mentioned Examples and Comparative Examples, a 50% gray solid image was printed on each 10 sheets under low temperature and low humidity environment (10° C., 20% RH) and on each 10 sheets under high temperature and high humidity environment (30° C., 80% RH). Presence or absence of transport deficiency such as transport unevenness, multi-paper supplying, and paper supplying deficiency was visually confirmed, and evaluated according to the following evaluation criteria.

<Evaluation Criteria>

A: No transport deficiency was generated.

B: Slight transport deficiency was observed with very low frequency.

C: Transport deficiency was generated, which was not acceptable in practical use —3. Quality—

After printing on A4 size sheets was finished, the qualities such as elasticity and curling of each sheet for inkjet printing when it was held by hand was ranked according to the following evaluation criteria, based on the results evaluated when held by five people.

<Evaluation Rank>

A: Quality for photographic paper was high.

B: Quality for photographic paper was slightly deteriorated.

C: Quality was not acceptable for photographic paper.

TABLE 1

| | Presence or absence of embossing on back face/shape | Brittleness | Transport ability | Quality |
|---|---|---|---|---|
| Example 1 | Triangular waveform (pitch: 0.5 mm, amplitude: 50 μm) | 4 | A | A |
| Example 2 | Rectangular waveform (pitch: 1 mm, amplitude: 50 μm) | 4 | A | A |
| Example 3 | Sinusoidal waveform (pitch: 0.5 mm, amplitude: 20 μm) | 4 | A | A |
| Comparative Example 1 | Cylinders (diameter: 1 mm, height: 20 μm each) | 2 | A | C |
| Comparative Example 2 | No embossing | 1 | C | A |

As shown in Table 1, in the Examples in which linear concavities and convexities were provided on the back face, an effect for alleviating brittleness of the ink-receiving layer was high, and a good result was obtained also in transportability and quality.

On the contrary, in Comparative Example 1 in which conventional embossing was carried out, an effect for preventing brittleness of the ink-receiving layer was not obtained, and quality was inferior. Furthermore, in Comparative Example 2 wherein the back face was not embossed, the ink-receiving layer had brittleness and was inferior in transportability.

What is claimed is:

1. An inkjet recording medium comprising a resin-coated paper comprising a base paper and at least one resin layer on each of both faces of the base paper, and an ink-receiving layer on one face of the resin-coated paper, wherein the inkjet recording medium comprises linear concavities and convexities that are formed in parallel or approximately parallel to any one side of the resin-coated paper on at least a part of the face of the resin-coated paper on which the ink-receiving layer is not formed, and wherein the linear concavities and convexities are formed at a predetermined pitch in a direction orthogonal to the linear direction of the concavities and convexities.

2. The inkjet recording medium according to claim 1, wherein a cross-section of the recording medium along a direction orthogonal to the linear direction of the linear concavities and convexities has a rectangular shape, a wave shape or a triangular shape.

3. The inkjet recording medium according to claim 1, wherein the linear concavities and convexities are formed in parallel or approximately parallel to a direction orthogonal to a transport direction in which the medium is transported during recording.

4. The inkjet recording medium according to claim 1, wherein a thickness of the base paper is 40 to 250 μm.

5. The inkjet recording medium according to claim 1, wherein the resin layer comprises a thermoplastic resin.

6. The inkjet recording medium according to claim 1, wherein the resin layer comprises a polyolefin resin.

7. The inkjet recording medium according to claim 1, wherein a thickness of the resin layer is 10 to 50 μm.

8. The inkjet recording medium according to claim 1, wherein the ink-receiving layer comprises inorganic particles and a water-soluble binder.

9. The inkjet recording medium according to claim 8, wherein the inorganic particles comprise silica, alumina or pseudo boehmite.

10. The inkjet recording medium according to claim 1, wherein the water-soluble binder comprises a polyvinyl alcohol resin.

* * * * *